US005661428A

United States Patent [19]

Li et al.

[11] Patent Number: 5,661,428

[45] Date of Patent: Aug. 26, 1997

[54] FREQUENCY ADJUSTABLE, ZERO TEMPERATURE COEFFICIENT REFERENCING RING OSCILLATOR CIRCUIT

[75] Inventors: Wen Li; Manny K. F. Ma, both of Boise, Id.

[73] Assignee: Micron Technology, Inc., Boise, Id.

[21] Appl. No.: 631,993

[22] Filed: Apr. 15, 1996

[51] Int. Cl.[6] ..... G05F 3/08

[52] U.S. Cl. ..... 323/313

[58] Field of Search ..... 331/57; 307/296.8, 307/296.2, 304; 323/313–315

[56] References Cited

U.S. PATENT DOCUMENTS

| | | | |
|---|---|---|---|
| 5,126,590 | 6/1992 | Chern | 307/296 |
| 5,182,529 | 1/1993 | Chern | 331/57 |

OTHER PUBLICATIONS

Hoi-Jung Yoo, et al., "A Precision CMOS Voltage Reference with Enhanced Stability for the Application to Advanced VLSI's", *1993 IEEE International Symposium on Circuits and Systems,* vol. 2 of 4, 1318–1321, (May 3–6, 1993).

*Primary Examiner*—Aditya Krishnan

*Attorney, Agent, or Firm*—Schwegman, Lundberg, Woessner & Kluth, P.A.

[57] ABSTRACT

A frequency adjustable, zero temperature coefficient referencing ring oscillator circuit includes a plurality of inverter stages each having a switching circuit that produces the oscillating output signal for the ring oscillator circuit and a control circuit that controls the switching circuit to establish the frequency of the output signal, the control circuit including field-effect transistors which are operated as output resistance controllable devices and which have their operating points, and thus their output resistances, established by a reference voltage that is produced by a precision reference voltage generating circuit so that the operating frequency of the ring oscillator circuit can be set by adjusting the value of the reference signals produced by the precision reference signal generating circuit and is maintained at the setpoint value because the precision reference voltage generating circuit operates independently of variations in temperature and/or the power supply voltage. The ring oscillator circuit is fabricated as an integrated circuit device and the operating frequency of the integrated circuit ring oscillator circuit can be adjusted after fabrication and passivation of the integrated circuit device.

17 Claims, 3 Drawing Sheets

FREQUENCY ADJUSTABLE, ZERO TEMPERATURE COEFFICIENT REFERENCING RING OSCILLATOR CIRCUIT

FIELD OF THE INVENTION

The present invention relates to ring oscillator circuits, and more particularly, to an integrated circuit ring oscillator circuit including a reference signal source the operation of which is independent of temperature, and wherein the operating frequency of the integrated circuit ring oscillator circuit can be adjusted after fabrication and passivation.

BACKGROUND OF THE INVENTION

There are many applications in which highly stable oscillators are required, both in integrated circuit systems and in discrete systems. For example, in integrated circuit systems, highly stable oscillators are required for counters, frequency dividers, frequency multipliers, phase locked loops, charge pumps, and any other circuit which requires a constant clock frequency. Ring oscillator circuits frequently are used to provide the clock frequency in integrated circuit systems because ring oscillators lend themselves to fabrication using integrated circuit techniques. When a ring oscillator circuit is used to provide a time base in a digital system, the operating frequency of the ring oscillator circuit must be free from frequency drift caused for by variations in temperature or supply voltage. Various methods have been used to minimize the effects of temperature and supply voltage variations on circuit operation, including the use of complementary circuit stages so changes due to temperature and voltage variations offset one another. There is a need for a ring oscillator circuit formed by integrated circuit techniques and that includes a reference signal source that operates independently of variations in temperature.

A further consideration is that for oscillator circuits and other time base generating circuits that are formed by integrated circuit techniques, the operating frequency must be established during batch processing by producing a component, such as a resistance, of the oscillator circuit to have the value that is required to provide the desired operating frequency. Because the component values of integrated circuit devices are determined by the masks that are used in the production of the integrated circuit devices, the component values are fixed once the mask has been designed. Moreover, characteristics, such as the operating frequency of an oscillator formed on an integrated circuit device, cannot be verified until after batch processing and passivation of the integrated circuit device. Consequently, if after testing it is found that the operating frequency of such oscillator is not the desired frequency, the integrated circuit device which includes the oscillator cannot be used and design of the integrated circuit device has to be altered, for example, by taping out the mask to allow production of integrated circuit devices in which the oscillator circuit has the proper operating frequency. This results in increased production time and increased costs. Thus, there is a need to be able to adjust the frequency of an integrated circuit oscillator after fabrication and passivation of the integrated circuit oscillator.

For the reasons stated above, and for other reasons stated below which will become apparent to those skilled in the art upon reading and understanding the present specification, there is a need in the art for an oscillator circuit that can be formed as an integrated circuit device, and which includes a reference signal source, the operation of which is independent of variations in temperature, and wherein the operating frequency of the integrated circuit oscillator can be adjusted in a simple manner after fabrication and passivation of the integrated circuit oscillators.

SUMMARY OF THE INVENTION

The present invention provides a frequency adjustable, zero temperature coefficient referencing ring oscillator circuit having a plurality of cascaded inverter stages connected in a ring for producing an oscillating output having rising and falling transitions. Each inverter stage includes a switching circuit and a control circuit. The switching circuit for each inverter stage includes at least one semiconductor switching device. The control circuit for each inverter stage includes at least one output resistance controllable semiconductor device that has an output circuit for electrically coupling the switching device to a power source. A reference signal source is electrically coupled to the control circuit of each inverter stage for deriving from a supply voltage provided by the power source a reference signal for biasing the output resistance controllable semiconductor devices of each inverter stage at an operating point that provides an output resistance for the control circuit of each inverter stage that establishes the frequency of the output signal at a preselected value. In accordance with a preferred embodiment, the reference signal source has a zero temperature coefficient and operates independently of variations in the supply voltage. Moreover, in the preferred embodiment, the ring oscillator circuit is produced using integrated circuit techniques and the amplitude of the reference signal provided by the reference signal source is adjustable after fabrication of the integrated circuit device to permit adjustment in the operating frequency after fabrication has been completed.

Further in accordance with the invention, there is provided a method of providing an oscillating output signal having rising and falling transitions. The method comprises providing a plurality of inverter stages with each inverter stage including a switching circuit and a control circuit. The switching circuit for each inverter stage includes at least one semiconductor switching device and the control circuit for each inverter stage includes at least one output resistance controllable semiconductor device having an output circuit for electrically coupling the switching device to a power source. The method additionally includes connecting the plurality of cascaded inverter stages in a ring to form a ring oscillator circuit having an input and an output for producing the oscillating output signal at the output of the ring oscillator circuit, and controlling the output resistance controllable semiconductor devices of each inverter stage to establish the output resistances of the output resistance controllable semiconductor devices at values that provide a desired frequency for the output signal.

DESCRIPTION OF A PREFERRED EMBODIMENT

In the following detailed description of a preferred embodiment, reference is made to the accompanying drawings that form a part hereof, and in which are shown by way of illustration specific embodiments in which the invention may be practiced. It is to be understood that other embodiments may be utilized and structural changes may be made without departing from the scope of the present invention.

The frequency adjustable, zero temperature coefficient referencing ring oscillator circuit provided by the present invention can be used in any integrated circuit system or any discrete system that requires a constant clock frequency. For example, in integrated circuit systems, stable oscillators are used in counters, frequency dividers, frequency multipliers, phase locked loops, charge pumps, and other circuits wherein a constant frequency is required. Although in the preferred embodiment, the ring oscillator circuit is produced using integrated circuit techniques, the ring oscillator circuit can be produced as a discrete circuit.

Figure 1:
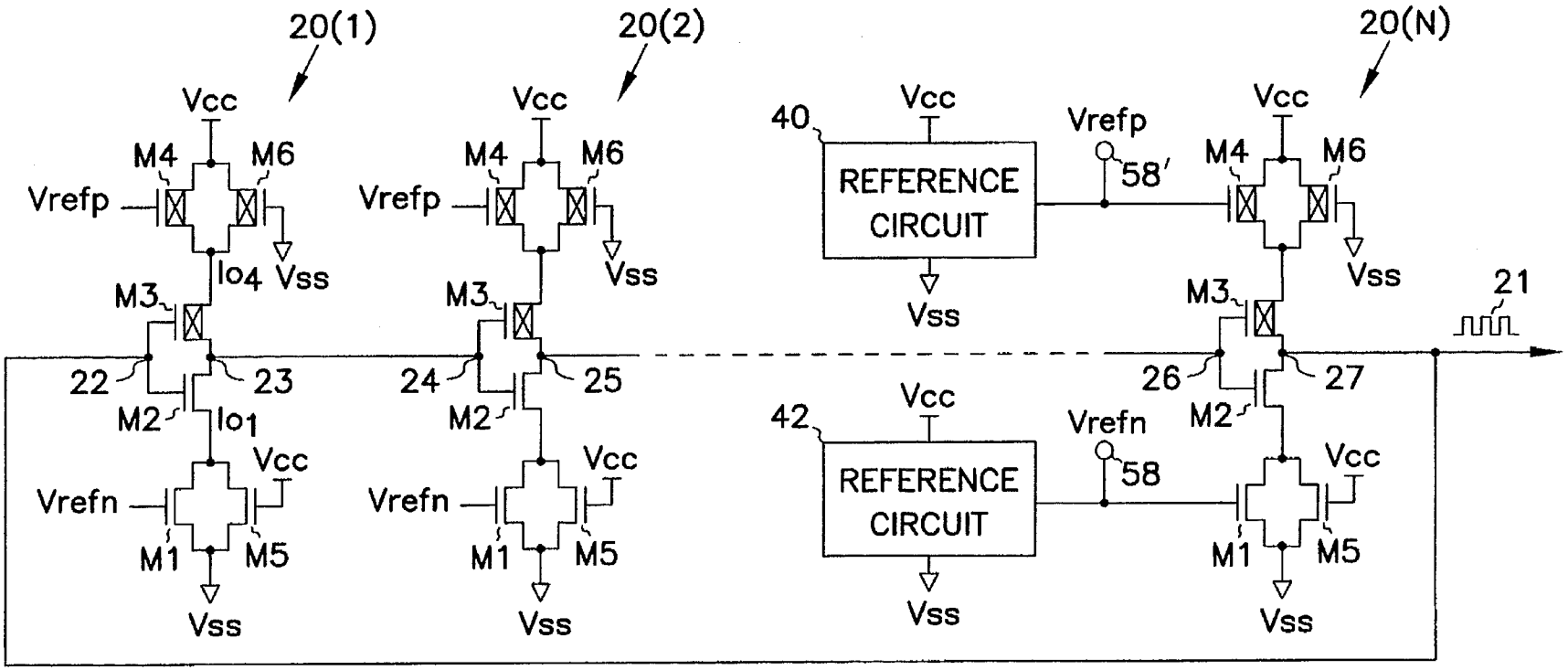
FIG. 1 is a schematic circuit diagram of a ring oscillator circuit provided by the present invention.

Referring to the drawings, FIG. 1 is a schematic circuit diagram of the ring oscillator circuit provided by the present invention. The ring oscillator circuit includes an odd number "N" of cascaded inverter stages, three of which are illustrated in FIG. 1 and given the reference numbers 20(1), 20(2) and 20(N). The inverter stages are connected in a serially connecting ring fashion with the output of each inverter stage being coupled to the input of the succeeding inverter stage in the ring and with the output of the last inverter stage 20(N) being coupled to the input of the first inverter stage 20(1). Thus, the output of inverter stage 20(1) at node 23 is connected the input of inverter stage 20(2) at node 24. The output of inverter stage 20(2) at node 25 is connected the input of inverter stage 20(N) at node 26. The output of inverter stage 20(N) at node 27, which is the output of the ring oscillator circuit in the exemplary embodiment, is connected the input of inverter stage 20(1) at node 22, which is the input of the ring oscillator circuit. The exact number "N" of inverter stages can be any odd number, three or greater, depending upon the delay through each stage and the frequency of oscillation that is desired for the ring oscillator circuit.

In the exemplary embodiment, each inverter stage, such as inverter stage 20(1), includes six semiconductor devices embodied as CMOS field-effect transistors M1–M6. Field-effect transistor M1, field-effect transistor M2 and field-effect transistor M5, hereinafter M1, M2 and M5, respectively, are N-channel field-effect transistors each having a gate, a first current node or drain, and a second current node or source. Field-effect transistor M3, field-effect transistor M4 and field-effect transistor M6, hereinafter M3, M4 and M6, respectively, are P-channel field-effect transistors each having a gate, a first current node, or source, and a second current node, or drain.

M2 and M3 are connected in series with one another and have their gates connected to node 22 at the input of the ring oscillator circuit. The drain of M2 and the drain of M3 are commonly connected to node 23. M1 and M5 are connected in parallel with one another, with respective drain electrodes commonly connected to the source electrode of M2 and with respective source electrodes commonly connected to $V_{ss}$. The gate of M1 is connected to the output 58 of a reference signal source 40 that provides a precision reference voltage Vrefn. The gate of M5 is connected to $V_{cc}$. Similarly, M4 and M6 are connected in parallel with one another, with respective source electrodes commonly connected to $V_{cc}$ and with drain electrodes commonly connected to the source electrode of M3. The gate of M4 is connected to the output 58' of a reference signal source 42 that provides a precision reference voltage Vrefp. The gate of M6 is connected to $V_{ss}$.

M2 and M3 are operated as a switching circuit for switching the signal output of the inverter stage 20(1) between $V_{cc}$ and $V_{ss}$ as a function of the voltage applied to the gates of M2 and M3. A typical value for the supply voltage $V_{cc}$ referred to herein is 3.3 volts and $V_{ss}$ is zero volts or ground connection for the ring oscillator circuit. It will be understood that different voltage levels could be used and are not intended to limit the scope of the present invention. The ring oscillator circuit produces a transitioning or oscillating output signal, a portion of which is represented by waveform 21, having rising and falling transitions between high and low conditions. The terms "high" and "low" as used herein refer to $V_{cc}$ (supply voltage) and $V_{ss}$ or ground, respectively.

M1, M4, M5 and M6 form a control circuit that controls the operation of the switching circuit. Parallel connected M4 and M6 are interposed between M3 of the switching circuit and $V_{cc}$. Parallel connected M1 and M5 are interposed between M2 of the switching circuit and $V_{ss}$ .

The six field-effect transistors M1–M6 of the inverter stages 20(2)–20(N) are connected in the same manner as for inverter stage 20(1) with field-effect transistors M2 and M3 operating as a switching circuit and field-effect transistors M1, M4, M5, and M6 operating as a control circuit.

Figure 2:
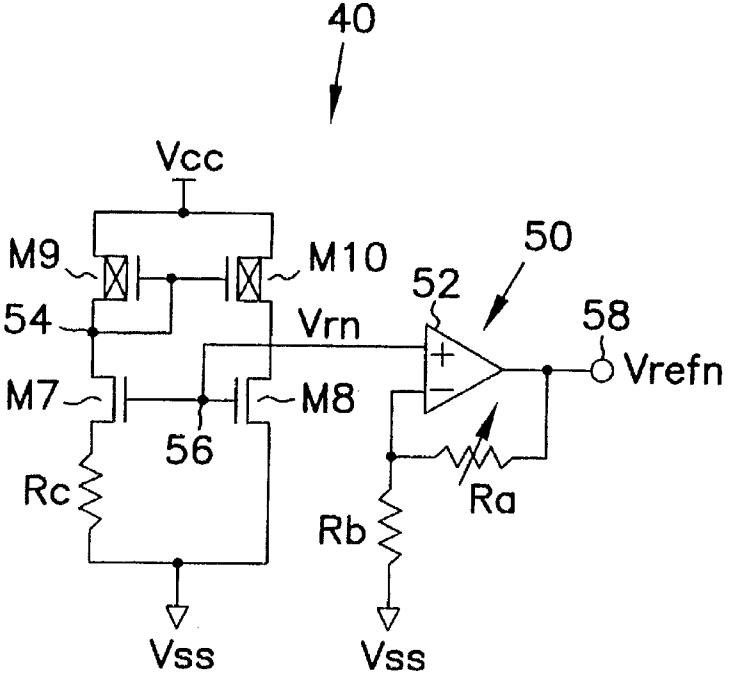
FIG. 2 is a schematic circuit diagram of a reference signal source for the n-channel device of the ring oscillator control circuit shown in FIG. 1.

Referring to FIG. 2, the reference signal source 40 that provides precision reference voltage Vrefn includes four semiconductor devices embodied as CMOS field-effect transistors M7–M10 and an amplifier circuit 50. The amplifier circuit 50 includes an operational amplifier 52 and feedback resistances Ra and Rb. The reference signal source 40 is similar to the reference voltage generator illustrated in FIG. 6 of an article by Hoi-Jun Yoo, et at., which is entitled "Precision CMOS Voltage Reference With Enhanced Stability for the Application to Advanced VLSI's", which appeared in the Proceedings—IEEE International Symposium on Circuits and Systems, Volume No. 2, 1993, pages 1318–1321 and which article is incorporated herein by reference.

Field-effect transistor M7 and field-effect transistor MS, hereinafter M7 and M8, respectively, are N-channel field-effect transistors. Field-effect transistor M9 and field-effect transistor M10, hereinafter M9 and M10, respectively, are P-channel field-effect transistors. M9 and M7 have their output circuits connected in series with a resistance Rc between $V_{cc}$ and $V_{ss}$. M8 and M 10 have their output circuits connected in series between $V_{cc}$ and $V_{ss}$. The gates of M9 and M10 are commonly connected to node 54 which is connected to the junction of the output circuits of M9 and M7. The gates of M7 and M8 are commonly connected to the node 56 which is connected to the non-inverting input of the operational amplifier 52.

The operational amplifier 52 is connected for operation as a high gain, non-inverting amplifier with feedback resistances Ra and Rb establishing the gain of the amplifier. Resistance Ra is connected between the output of the operational amplifier and the inverting input of the operational amplifier. Resistance Rb is connected between $V_{ss}$ and the inverting input of the operational amplifier. The reference voltage Vrefn provided by the reference signal source 40 is a positive voltage the amplitude of which is given by equation (1):

$$Vrefn = \frac{(Ra + Rb)}{Rb} * Vrn \quad (1)$$

where Vrn is the voltage appearing at the gates of M7 and M8. The voltage Vrn is given by equation (2):

$$Vrn = Vthn + \frac{2}{(R*\beta_8)} *[1 - (1/\sqrt{K})] \quad (2)$$

where Vthn is the threshold voltage of the N-channel field effect transistor M1 and $K=\beta_7/\beta_8$, with $\beta_7$ being the gain factor of M7 and $\beta_8$ being the gain factor for M8. Equation (2) corresponds to a correspondingly numbered equation that is set forth on page 1319 of the referenced article. As is disclosed in the referenced article, the magnitude of the reference voltage is independent of the external supply voltage.

Figure 3:
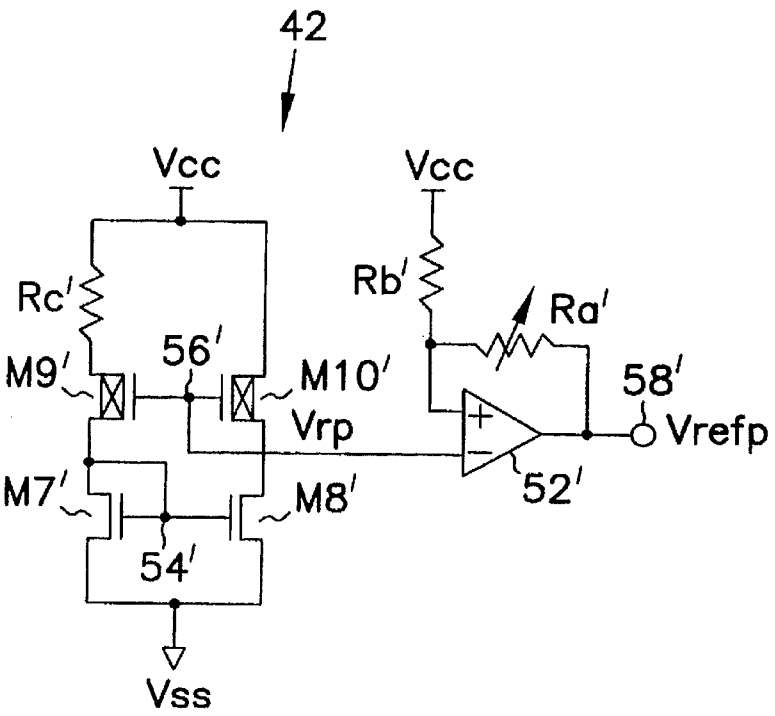
FIG. 3 is a schematic circuit diagram of a reference signal source for the p-channel device of the ring oscillator control circuit shown in FIG. 1.

Referring to FIG. 3, the reference signal source 42 that provides the precision reference voltage Vrefp is similar to reference signal source 40, but is complementary in structure to the reference signal source 40. Accordingly, the elements of reference signal source 42 have been given the same reference number as corresponding elements of reference signal source 40, but with a prime notation (′). In reference signal source 42, the resistance Rc′ is connected between $V_{cc}$ and M9′ and M7′. The gates of M7′ and M8′ are commonly connected to node 54′ which is connected to the output circuits of M9′ and M7′. The gates of M9′ and M10′ are commonly connected to node 56′ which is connected to the inverting input of the operational amplifier 52′. The reference voltage Vrefp is a positive voltage, the amplitude of which is greater than the amplitude of Vrefn and which is given by equation (3):

$$Vrefp = \frac{(Ra' + Rb')}{Rb'} * Vrp \quad (3)$$

where Vrp is the voltage appearing at the gates of M9′ and M10′ and is approximately equal to $V_{cc}$–Vrn.

As will be shown, the precision reference voltages Vrefn and Vrefp establish the operating points for n-channel device M1 and the opposite polarity p-channel device M4, thereby determining the output resistances of M1 and M4 which, in turn, determine the operating frequency for the ring oscillator circuit. Thus, the reference signal sources derive from the supply voltage reference signals Vrefn and Vrefp for biasing the semiconductor devices M1 and M4 of the control circuit of each inverter stage at an operating point that provides an output resistance for the control circuit of each inverter stage that establishes the frequency of the output signal 21.

In accordance with another aspect of the invention, the resistances Ra and Ra′ which establish the values of the reference voltages Vrefn and Vrefp, respectively, are laser trimmable so that the reference voltages Vrefrn and Vrefp, and thus the operating frequency of the ring oscillator circuit, can be adjusted after testing. This obviates the need to fabricate the reference voltage sources 40 and 42 to a precise resistance in order to obtain the reference voltage that is required to establish a desired operating frequency for the ring oscillator circuit.

Referring again to FIG. 1, M2 and M3 are operated in saturation and switch the output of the inverter stage between $V_{cc}$ and $V_{ss}$ as a function of the input signal level being applied to the input 22 of the inverter stage at the gates of M2 and M3. The size of the two field-effect transistors M2 and M3 is chosen so that the switching speed for the inverter stage "pulling up" and "pulling down" are approximately the same. M2 and M3 are selected so that their gain factors $\beta_2$ and $\beta_3$ are equal. In addition, $\beta_3$ is chosen to be about two to three times greater than $\beta_1$.

M1 and M4 function as output resistance controllable devices and have their output circuits connected for electrically coupling the switching devices M2 and M3 to the power source, i.e., between the supply voltage $V_{cc}$ and ground $V_{ss}$. The output circuits of M1 and M4 are connected in series with the output circuits of series connected M2 and M3. The output resistances of M1 and M4 are established by the values of the reference voltages Vrefn and Vrefp applied to the gates of M1 and M4, respectively. M1 and M4 are operated in the saturation region so that the output resistance Ro is defined as:

$$R_o = 1/\lambda * I_o \quad (4)$$

where $\lambda$ is defined as the channel modulation coefficient, and Io is the current flowing through M1 and M4. The output resistance Ro varies inverse linearly with the current Io flowing through M1 and M4.

The current $Io_1$ flowing through M1 and M2 during "pulling down" cycles, i.e., when $V_{cc}$ is being applied to the gate of the switching transistors FET2 and FET 3, is:

$$I_{o1} = \frac{[\beta_1 * (Vrefn - Vthn)^2]}{2} \quad (5)$$

where $\beta_1$ is the gain factor for M1 and where Vthn is the threshold voltage of the N-channel field effect transistor M1.

Similarly, the current $Io_4$ flowing though M3 and M4 during cycles for the "pulling up" cycles, i.e., when $V_{ss}$ is applied to the gate of the switching transistors, is:

$$I_{o4} = \frac{[\beta_4 * (V_{cc} - Vrefp - Vthp)^2]}{2} \quad (6)$$

where Vthp is the threshold voltage of the P-channel field effect transistor M4. The threshold voltages Vthn and Vthp are assumed to be equal and a typical value for the threshold voltages is 0.7 volt.

The gain factor $\beta_1$ for the N-channel field-effect transistor M1 and the gain factor $\beta_4$ for the P-channel field-effect transistor M4 are selected so that the high-to-low transition time, tPHL, and the low to high transition time, tPLH, are equal for the inverter stage.

M5 and M6 are connected for low bias operation and are operated as minimum bias transistors for initiating the operation of the ring oscillator circuit in response to application of power to the ring oscillator circuit. M5 and M6 are selected so that the gain factor $\beta_5$ of M5 is equal to the gain factor $\beta_6$ of M6. Moreover, gain factor $\beta_5$ is much smaller than gain factor $\beta_1$. Although the preferred embodiment of the ring oscillator circuit includes the minimum bias transistors M5 and M6, transistors M5 and M6 are not necessary for proper operation of the ring oscillator circuit. However, the presence of M5 and M6 is advantageous in that these transistors speed up achieving of steady state operation at the oscillating frequency under power-up conditions. Once the reference voltages Vrefn and Vrefp have been established at the gates of M1 and M4, the start-up field-effect transistors M5 and M6 are ineffective because $\beta_1 >> \beta_5$ (of M5). Likewise for the gain factor $\beta_4$ of M4 and the gain factor $\beta_6$ of M6, $\beta_4 >> \beta_6$. Consequently, when Vrefn and Vrefp become well established, the output resistances of M1 and M4 control the frequency of oscillation of the ring oscillator circuit.

The frequency of oscillation of the ring oscillator circuit is given by by equation (7):

$$f=1/(N*t) \quad (7)$$

where N is the number of inverter stages and "t" is the time delay constant for the inverter stage. The delay time constant "t" is given by equation (8).

$$t=A*C_{ox}*R_o \quad (8)$$

where A is a process constant, Cox is the gate oxide capacitance, and Ro is the output resistance of the field-effect transistor.

Thus, the frequency of oscillation of the ring oscillator circuit is inversely proportional to $Ro_1+Ro_2$ (the output resistances of M1 and M2) during "pulling down cycles", and is inversely proportional to $Ro_3+Ro_4$ (the output resistances of M3 and M4) during "pulling up cycles". However, the output resistance $Ro_1$ of M1 is much larger than the output resistance $Ro_2$ of M2. Also, the output resistance $RO_4$ of M4 is much larger than output resistance $Ro_3$ of M3. Therefore, the frequency of oscillation of the ring oscillator circuit is effectively determined by the output resistance of M1, during "pulling down" cycles, and by the output resistance of M4 during "pulling up" cycles.

The control circuit controls the time delay constant "t" of the inverter stage by establishing the resistances of the output circuit. The adjusting capability of the ring oscillator circuit frequency is achieved by controlling the values of resistances $Ro_1$ and $Ro_4$ through the precision reference voltages Vrefn and Vrefp. The output resistances $Ro_1$ and $Ro_4$ decrease with increase in the reference voltages Vrefn and $|V_{cc}-Vrefp.|$ The effect of adjusting resistance $Ro_4$ is to affect the speed of "pulling up". The resistances $Ro_1$ and $Ro_4$ are adjusted equally so that M1 and M4 have the same "pulling up" and "pulling down" speed. $Ro_1$ and $Ro_2$ are controlling for the positive, or "pulling down" cycles i.e., when voltage at level $V_{cc}$ is on the gate of the switching transistors and resistances $Ro_3$ and $Ro_4$ are controlling for the negative, or "pulling up" cycles i.e., when $V_{ss}$ is on the gate of the switching transistors M2 and M3.

Because resistance $Ro_1$>>resistance $Ro_2$, variation in the reference voltage Vrefn is the controlling element in setting the frequency of the ring oscillator circuit for "pulling down" cycles. Similarly, because resistance $Ro_4$>>resistance $Ro_3$, variation in the reference voltage Vrefp is the controlling element in setting the frequency of the ring oscillator circuit for "pulling down" cycles.

The gain factor $\beta_2$ for M2 is about three times the gain factor $\beta_1$ for M1, and the gain factor $\beta_1$ for M1 is much greater than the gain factor $\beta_5$ for M8. These conditions assure that the output resistances R1 and R4 of M1 and M4, respectively, are the controlling elements.

In accordance with a further aspect of the invention, the frequency of the ring oscillator circuit provided by the invention can be adjusted after fabrication and passivation of the integrated circuit device has been completed. For the purpose of setting the values of resistances Ra and Ra', the integrated circuit device is tested at two different times during the production of the integration circuit device. The first test is conducted after fabrication and passivation. This test is used to determine the initial operating frequency for the ring oscillator circuit as produced in the integrated circuit process. The second test is conducted after the resistances Ra and Ra' of the reference signal sources 40 and 42 have been laser trimmed in adjusting the operating frequency of the ring oscillator circuit to the value required to provide reference voltages that establish the operating frequency for the ring oscillator circuit at the design frequency.

In accordance with another aspect of the invention, the sources 40 and 42 of the precision voltage references Vrefn and Vrefp have a zero temperature coefficient in addition to operating independently of variations in the supply voltages $V_{cc}$ and $V_{ss}$. Thus, the reference voltages are independent of temperature variations as well as to variations in the supply voltages. The reference voltage Vrefn is given by equation (2) and is proportional to Vrn. The temperature variation of the voltage Vrn can be defined by equation (9):

$$\frac{dVrn}{dT}=\frac{dV_{th}}{dT}+\frac{2}{R\beta_7}\left[1-\frac{1}{\sqrt{K}}\right]\left[\frac{3}{2T}-\frac{1}{R}\ \frac{dR}{dT}\right] \quad (9)$$

where Vrn corresponds to the output reference voltage provided by reference signal source 40 and where $K=\beta_7/\beta_8$, with $\beta_7$ being the gain factor for field-effect transistor M7 and $\beta_8$ being the gain factor the field-effect transistor M8. The term 3/2T is derived from the temperature coefficient of the transconductance KP of M8. The term 1/R[dR/dT] is the temperature coefficient of resistor Rc. R is the resistance Rc connected in series with M7 and M9 in the reference signal generating circuit shown in FIG. 2.

By setting dVrn/dT equal to zero, a value for K can be determined that will establish a zero temperature coefficient for the ring oscillator circuit. When dVrn/dT is equal to zero, the reference voltage Vref is independent of temperature.

The term 3/2T can be derived from the temperature coefficient of the process transconductance $KP_8$ of M8 as follows.

$$\beta_8=KP_8\left[\frac{W_{m8}}{L_{m8}}\right] \quad (10)$$

where $KP_8$ is the transconductance of M8 and $W_{m8}$ and $L_{m8}$ are the channel width and length of M8.

$$KP(T)=KP(T_o)\left(\frac{T}{T_o}\right)^{-1.5} \quad (11)$$

where $T_o$ is a reference temperature, such as ambient temperature, and T is the temperature of M8. Taking the derivative of equation (11) with respect to temperature:

$$\frac{dKP(T)}{dT}=KP(T_o)\left(\frac{T}{T_o}\right)^{-1.5}\left[\frac{-1.5}{T}\right] \quad (12)$$

Setting T equal to $T_o$ in equation (12) and simplifying results in:

$$\frac{1}{KP}\ \frac{dKP}{dT}=-\frac{1.5}{T}=-\frac{3}{2T} \quad (13)$$

By way of example, a typical value of 3/2T is about 0.005/°C. The temperature coefficient of resistor Rc is about 2000 ppm/°C. The term dVth/dT typically evaluates to about −2.4 millivolts per °C. A typical value of $\beta_8$ is 180 microamps per volt. If K is chosen as 4, then $\beta_7=K\beta_8=720$ microamps per volt. The resistance Rc is about 4.5 Kohms.

A similar analysis can be carried out with respect to the reference voltage Vrefp provided by the reference signal source 42 to illustrate that the reference voltage Vrefp also is independent of temperature when the ratio of the gain factor $\beta_9'$ for field-effect transistor M9' and the gain factor $\beta_{10}'$ for the field-effect transistor M10' are properly selected. In carrying out this analysis, equation (9) can be modified by substituting Vrp for Vrn, the gain factors of M9' and M10' for the gain factors of M7 and M8, for example. As is the case for Vrefn, a typical value of 3/2T is about 0.005/°C. The term 1/R[dR/dT], the temperature coefficient for resistor Rc' is about 2000 ppm/°C. The term dVth/dT typically evaluates to about −2.4 millivolts per °C. A typical value of $\beta_{10}'$ is 180 microamps per volt. If K is chosen as 4, then $\beta_9'=K\beta_{10}'=720$ microamps per volt. The resistance Rc' is about 4.5 Kohms.

Referring to FIG. 1, for the purpose of describing the operation of the ring oscillator circuit provided by the present invention, it is assumed initially that power is not being applied to the circuit. At power up, $V_{cc}$ and $V_{ss}$, which is assumed to be ground potential, are applied to all the inverter stages and to the reference signal sources. Because the gate of M6 is connected to ground ($V_{ss}$), M6 is turned on and M3 is electrically connected to $V_{cc}$ through M6. Similarly, because the gate of M5 is connected to $V_{cc}$, M5 is turned on and M2 is electrically connected to ground through M5.

Assuming that the gates of M2 and M3 are initially at ground potential, the output of the first inverter stage 20(1) is at level $V_{cc}$ and this output is applied to the input to the second inverter stage 20(2) of the ring oscillator circuit. Therefore, the output of the second inverter stage 20(2) is at ground, etc. After propagating through an odd number of invertor stages, the output of the last inverter stage, inverter stage 20(N) in the exemplary embodiment, is at level $V_{cc}$. Accordingly, a voltage at level $V_{cc}$ is fed back to the input of the first inverter stage 20(1) at the gates of M2 and M3.

In the mean time, the reference voltages Vrefn and Vrefp become established and take control of the output resistance of each inverter stage. Once this happens, the switching time or time delay "t" of each inverter stage is defined and the frequency of the oscillation is defined for the ring oscillator circuit.

By way of example of an application of the ring oscillator circuit provided by the invention, the ring oscillator circuit can be incorporated into an integrated circuit memory system wherein the ring oscillator circuit provides drive signals for a charge pump which in turn provides row and column select signals for the memory array of the integrated circuit memory device. An example of one such integrated circuit memory device is a burst EDO memory device, such as that disclosed in U.S. patent application Ser. No. 08/370,761, entitled BURST EDO MEMORY DEVICE, by Zagar et al., and assigned to the assignee of the present invention, which application is incorporated herein by reference.

Figure 4:
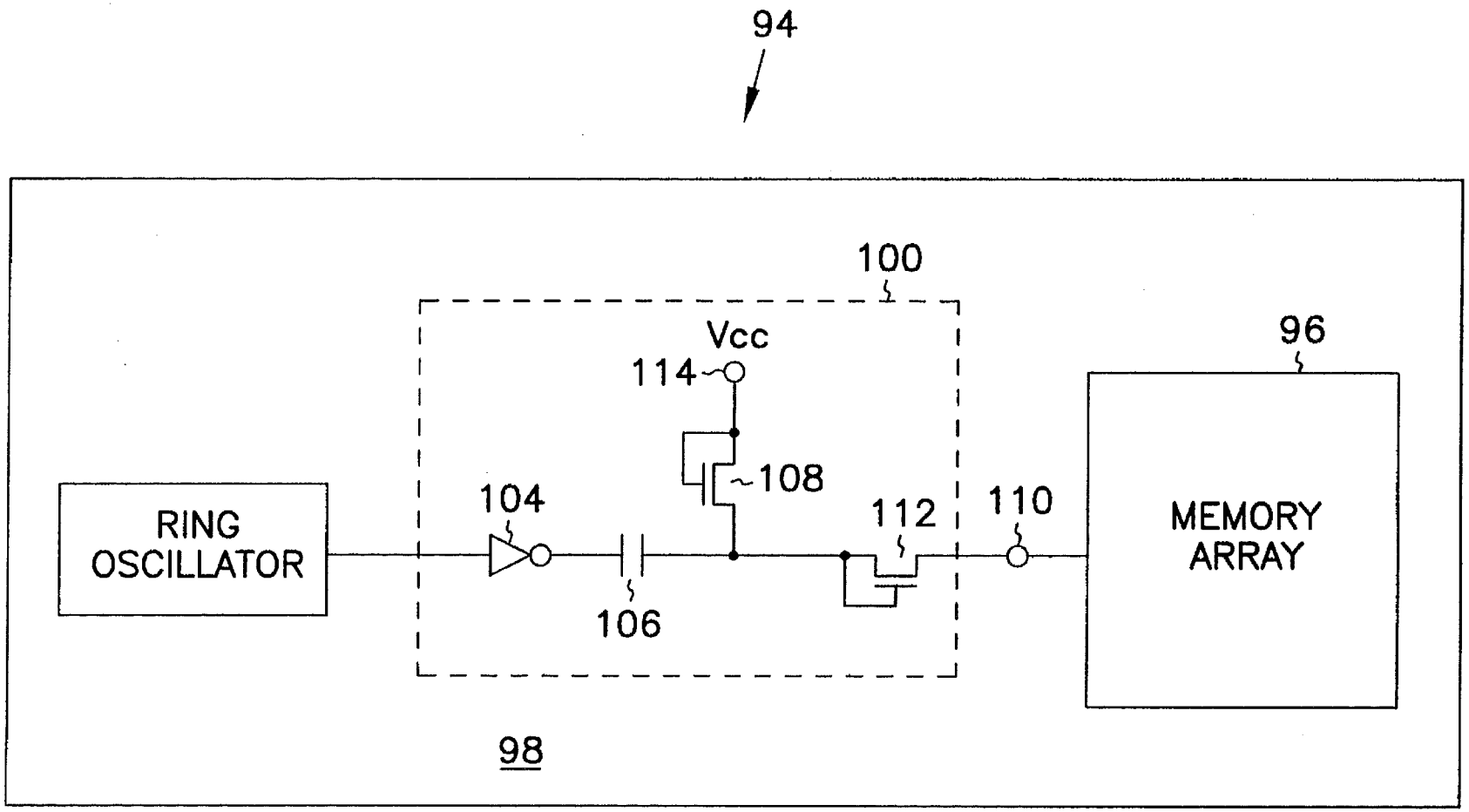
FIG. 4 is a partial schematic circuit and block diagram of a memory system including a charge pump that is driven by the ring oscillator circuit provided by the present invention.

Referring to FIG. 4, there is illustrated an integrated circuit memory system 94 including a memory array 96 formed on a die 98. The integrated circuit memory system 94 includes a charge pump 100 that is driven by the ring oscillator circuit provided by the present invention for providing drive signals for access transistors (not shown) of a memory array 96 of the integrated circuit memory system, all of which are formed on the die 98 using conventional integrated circuit techniques. The ring oscillator circuit provides a square wave oscillating signal having voltage swings between the supply voltage $V_{cc}$ and $V_{ss}$ or ground. The exemplary charge pump 100 is a basic single phase charge pump having an inverter 104 for sharpening the edges of the oscillating output signal of the ring oscillator circuit. The charge pump includes a capacitor 106 that is discharged through the output 110 via diode connected transistor 112. Transistor 108 is coupled to the external power supply voltage, $V_{cc}$, at terminal 114.

When the ring oscillator circuit produces a voltage close to $V_{cc}$, the output of inverter 104 is low and circuit node 116 is approximately at the voltage of the power supply minus a threshold voltage ($V_{cc}$−Vt) as provided by transistor 108. When the ring oscillator circuit transitions to a low voltage, the output of inverter 104 goes high and boosts the charge on capacitor 106. The incremental charge on capacitor 106 is delivered to output 110 through transistor 112. The charge on capacitor 106 is therefore pumped above $V_{cc}$ to produce a voltage $V_{ccp}$. The voltage $V_{ccp}$ is used to drive access transistors (not shown) of the memory array 96 in the manner known in the art.

Although in the preferred embodiment, the ring oscillator circuit is described with reference to an application in an integrated circuit memory system in which the ring oscillator circuit provides drive signals for a charge pump of the memory system, it will be understood by those skilled in the art that the ring oscillator circuit of the invention can be used in other integrated circuit systems, and in discrete circuit systems, including counters, frequency dividers, frequency multipliers, phase locked loops, charge pumps, or any other circuit of such integrated circuit systems and discrete systems which require a constant clock frequency.

CONCLUSION

There has been described a frequency adjustable, zero temperature coefficient referencing ring oscillator circuit that includes a plurality of inverter stages each having a switching circuit and a control circuit. The switching circuit produces the oscillating output signal for the ring oscillator circuit and the control circuit controls the switching circuit to establish the frequency of the output signal. To this end, the control circuit includes field-effect transistors which are operated as output resistance controllable devices and which have their operating points, and thus their output resistances, established by a reference voltage that is produced by a precision reference voltage generating circuit. Accordingly, the operating frequency of the ring oscillator circuit can be set by adjusting the value of the reference signals produced by the precision reference signal generating circuit and is maintained at the setpoint value because the precision reference voltage generating circuit operates independently of variations in temperature and/or the power supply voltage.

In accordance with a feature of the invention, the resistance components of the reference voltage sources which establish the values of the reference voltages are laser trimmable so that the reference voltages, and thus the operating frequency of the ring oscillator circuit, can be adjusted after testing. This obviates the need to fabricate the precision reference voltage sources to a precise resistance in order to obtain the reference voltage that is required to establish a desired operating frequency for the ring oscillator circuit.

While in a preferred embodiment, the ring oscillator circuit has been described with reference to an application with a charge pump circuit in an integrated circuit memory device for providing a precise time base signal for the charge pump which provides drive signals for an integrated circuit memory device. However, it will be understood by those skilled in the art that the ring oscillator circuit of the invention can be used in discrete circuit systems or in integrated circuit systems such as in counters, frequency dividers, frequency multipliers, phase locked loops, charge pumps, or any other circuit which require a constant clock frequency. The ring oscillator circuit includes a plurality of inverter stages each having a switching circuit and a control circuit for controlling the switching circuit. The ring oscillator circuit can be used in any integrated circuit system or any discrete system that requires a constant clock frequency.

Therefore, although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A frequency adjustable, zero temperature coefficient referencing ring oscillator circuit comprising:

a plurality of cascaded inverter stages connected in a ring for producing an oscillating output signal having rising and falling transitions;

each inverter stage including a switching circuit and a control circuit, said switching circuit for each inverter stage including at least one semiconductor switching device and said control circuit for each inverter stage including at least one semiconductor device which is operated as an output resistance controllable device and which has an output circuit connected for electrically coupling said at least one switching device to a power source; and a reference signal source electrically coupled to said control circuit of each inverter stage for deriving from a supply voltage provided by said power source a reference signal for biasing said semiconductor device of said control circuit of each inverter stage at an operating point that provides an output resistance for the control circuit of each inverter stage that establishes the frequency of said output signal at a preselected value, said reference signal source being constructed and arranged to cause said reference signal to have a zero temperature coefficient.

2. The ring oscillator circuit of claim 1, wherein said reference signal produced by said reference signal source is independent of variations in said supply voltage provided by said power source.

3. The ring oscillator circuit of claim 1, wherein said control circuit of each inverter stage includes first and second semiconductor devices, said first and second semiconductor devices being respective first and second field-effect transistors having output circuits that establish the output resistance for said control circuit of each inverter stage, and wherein said reference signal source includes a first reference voltage source for providing a first reference voltage for said first field-effect transistor and a second reference voltage source for providing a second reference voltage for said second field-effect transistor, said first and second reference voltage sources including respective first and second reference stages for producing a precision voltage that is independent of temperature, said first reference stage including a first pair of field-effect transistors, the field-effect transistors of said first pair having respective gain factors that establish a zero temperature coefficient for said first reference voltage, and said second reference stage including a second pair of field-effect transistors, the field-effect transistors of said second pair having respective gain factors that establish a zero temperature coefficient for said second reference voltage.

4. The ring oscillator circuit of claim 3, wherein said first and second field-effect transistors are operated in the saturation region, whereby the output resistance of said first field-effect transistor is inversely proportional to the current flowing through the output circuit of said first field-effect transistor, and the output resistance of said second field-effect transistor is inversely proportional to the current flowing through the output circuit of said second field-effect transistor.

5. The ring oscillator circuit of claim 3, wherein said switching circuit of each inverter stage comprises first and second semiconductor switching devices, said first and second semiconductor switching devices being third and fourth field-effect transistors, respectively, said third and fourth field-effect transistors having respective output circuits which are connected in series with one another, and in series with said output circuits of said first and second field-effect transistors.

6. The ring oscillator circuit of claim 5, wherein said control circuit of each inverter stage includes fifth and sixth field-effect transistors, said fifth field-effect transistor having a control input gate connected to receive said supply voltage, and said sixth field-effect transistor having a control input connected to a reference potential, whereby said fifth and sixth field-effect transistors provide low bias operation for initiating the operation of the ring oscillator circuit in response to the application of power thereto.

7. The ring oscillator circuit of claim 3, wherein said plurality of cascaded inverter stages and said reference signal source are formed as an integrated circuit device.

8. The ring oscillator circuit of claim 7, wherein said first and second reference voltage sources each include an output stage, said output stages each including a high gain amplifier for amplifying the precision voltage to produce the first and second reference voltages and the high gain amplifier of each output stage including first and second resistance means for determining the amplitude of said first and second reference signals, respectively, and wherein said first and second resistance means are fabricated in the integrated circuit device, and at least one of said resistance means of each of said output stages being adapted to be adjusted by laser trimming after fabrication of said plurality of inverter stages and said first and second reference voltage sources as an integrated circuit device, for changing the amplitude of the reference signals to thereby adjust the frequency of said output signal.

9. The ring oscillator circuit of claim 1, wherein said control circuit of each inverter stage includes first and second output resistance controllable semiconductor devices which are embodied as first and second field-effect transistors of opposite polarities, respectively, and wherein said switching circuit of each inverter stage includes first and second semiconductor switching devices which are embodied as third and fourth field-effect transistors of opposite polarities, and which are operated in a switching mode to provide pull-up cycles and pull-down cycles for said switching circuit; said first and second field-effect transistors electrically coupling said third and fourth field-effect transistors to said power source, and wherein said reference signal source includes a first reference voltage source for providing a first reference voltage which is electrically coupled to said first field-effect transistor for establishing the output resistance of said first field-effect transistor to a given value, and a second reference voltage source for providing a second reference voltage that is electrically coupled to said second field-effect transistor for establishing the output resistance of said second field-effect transistor to a given value; the output resistance of said first field-effect transistor establishing the frequency of said output signal for said pull-up cycles and the output resistance of said second field-effect transistor establishing the frequency of said output signal at a preselected value for said pull-down cycles.

10. The ring oscillator circuit of claim 9, wherein said plurality of cascaded inverter stages and said reference signal source are formed as an integrated circuit device, and wherein the frequency of said output signal is adjustable by adjusting the value of at least one of said reference voltages.

11. An integrated circuit memory system comprising:

a memory array and a drive circuit for said memory array, said drive circuit including a charge pump and a ring oscillator circuit for providing drive signals for said charge pump, said ring oscillator circuit including a plurality of cascaded inverter stages connected in a ring for producing an oscillating output signal, each inverter stage including a switching circuit and a control circuit, said control circuit for each inverter stage including at least first and second field-effect transistors of opposite polarities, said first and second field-effect transistors being connected for operation as an output resistance controllable device, and said switching circuit for each inverter stage including third and fourth field-effect transistors of opposite polarities, said first and second field-effect transistors electrically coupling said third and fourth field-effect transistors to respective first and second outputs of a voltage source that provides a supply voltage; and a first reference signal source electrically coupled to said first field-effect transistor for providing a first reference voltage for said first field-effect transistor that establishes the value of the output resistance of said first field-effect transistor and a second reference signal source electrically coupled to said second field-effect transistor for providing a second reference voltage for said second field-effect transistor that establishes the value of the output resistance of said second field-effect transistor, the output resistance values of said first and second field-effect transistors determining the frequency of said output signal, said first and second reference signal sources being constructed and arranged to cause said first and second reference voltages to have a zero temperature coefficient.

12. The integrated circuit memory system of claim 11, wherein said first and second reference signal sources each operates independently of variations in said supply voltage.

13. The integrated circuit memory system of claim 11, wherein the frequency of said output signal is adjustable by adjusting the value of said first and second reference voltages, causing a corresponding adjustment in the values of the output resistances of said first and second field-effect transistors.

14. The integrated circuit memory system of claim 13, wherein said control circuit of each inverter stage includes fifth and sixth field-effect transistors, said fifth field-effect transistor having a control input connected to receive said supply voltage, and said sixth field-effect transistor having a control input connected to a reference potential, whereby said fifth and sixth field-effect transistors provide low bias operation for initiating the operation of the ring oscillator circuit in response to the application of power.

15. A method of providing an oscillating output signal having rising and falling transitions, comprising:

providing a plurality of inverter stages with each inverter stage including a switching circuit and a control circuit, the switching circuit for each inverter stage including at least one semiconductor switching device, and the control circuit for each inverter stage including at least one semiconductor device which is connected for operation as an output resistance controllable semiconductor device and which has an output circuit for electrically coupling the switching device to a power source;

connecting said plurality of cascaded inverter stages in a ring to form a ring oscillator circuit having an input and an output for producing said oscillating output signal at said output of said ring oscillator circuit;

producing a reference voltage having a zero temperature coefficient;

applying the reference voltage to control inputs of the semiconductor devices of the control circuit of each inverter stage to establish the output resistances of said semiconductor devices at values that provide a desired frequency for said output signal.

16. The method according to claim 15, including adjusting the amplitude of the reference voltage to effect a corresponding adjustment in the output resistance of said semiconductor devices.

17. The method according to claim 15, including fabricating said plurality of inverter stages and said reference signal source as an integrated circuit device; and including adjusting a resistance means of said reference signal source after fabrication and passivation of said plurality of inverter stages and said reference signal source as an integrated circuit device, to thereby adjust said reference signal, and thus the frequency of said oscillating output signal.

* * * * *